United States Patent [19]

Bergeron

[11] Patent Number: 4,984,971

[45] **Date of Patent: * Jan. 15, 1991**

[54] ANTI-VIBRATORY DEVICE TO ATTACH A HERMETIC COMPRESSER CHAMBER TO ITS BASE

[75] Inventor: Emile Bergeron, La Verpilliere, France

[73] Assignee: L'Unite Hermetique, La Verpilliere, France

[ * ] Notice: The portion of the term of this patent subsequent to Jun. 15, 2003 has been disclaimed.

[21] Appl. No.: 326,204

[22] Filed: Dec. 1, 1981

[51] Int. Cl.[5] ..... F04B 39/12; F16M 7/00

[52] U.S. Cl. ..... 417/363; 417/902; 248/621; 248/635

[58] Field of Search ..... 417/363, 360, 902; 248/621, 619, 632, 634, 635

[56] References Cited

U.S. PATENT DOCUMENTS

| | | | |
|---|---|---|---|
| 2,407,804 | 9/1946 | Winchel | 248/532 X |
| 2,493,171 | 1/1950 | Touborg | 417/372 |
| 2,551,514 | 5/1951 | Truelove et al. | 248/635 X |
| 3,104,051 | 9/1963 | Henning et al. | 417/419 |
| 3,403,847 | 10/1968 | Parker | 417/454 |
| 4,118,153 | 10/1978 | Stannow et al. | 417/363 |
| 4,306,708 | 12/1981 | Gassaway et al. | 248/635 X |

FOREIGN PATENT DOCUMENTS

| | | |
|---|---|---|
| 1085898 | 7/1960 | Fed. Rep. of Germany . |
| 1092936 | 11/1960 | Fed. Rep. of Germany . |
| 1210472 | 9/1959 | France . |
| 2349044 | 11/1977 | France . |
| 202626 | 1/1939 | Switzerland . |

*Primary Examiner*—Carlton R. Croyle
*Assistant Examiner*—Peter M. Cuomo
*Attorney, Agent, or Firm*—Cushman, Darby & Cushman

[57] ABSTRACT

An anti-vibratory device for attaching a hermetic compressor chamber to a base, comprises a first part located inside the chamber, consisting of several springs placed between the compressor and studs fixed to the bottom of the chamber, and a second part consisting of a block of elastic material, with means of fixing this to the chamber and the base. The underside of each stud is provided with a threaded recessed hole accessible from outside the chamber and each block of elastic material is fixed to the base and corresponding stud, and thereby to the chamber, by means of a screw into this hole.

6 Claims, 3 Drawing Sheets

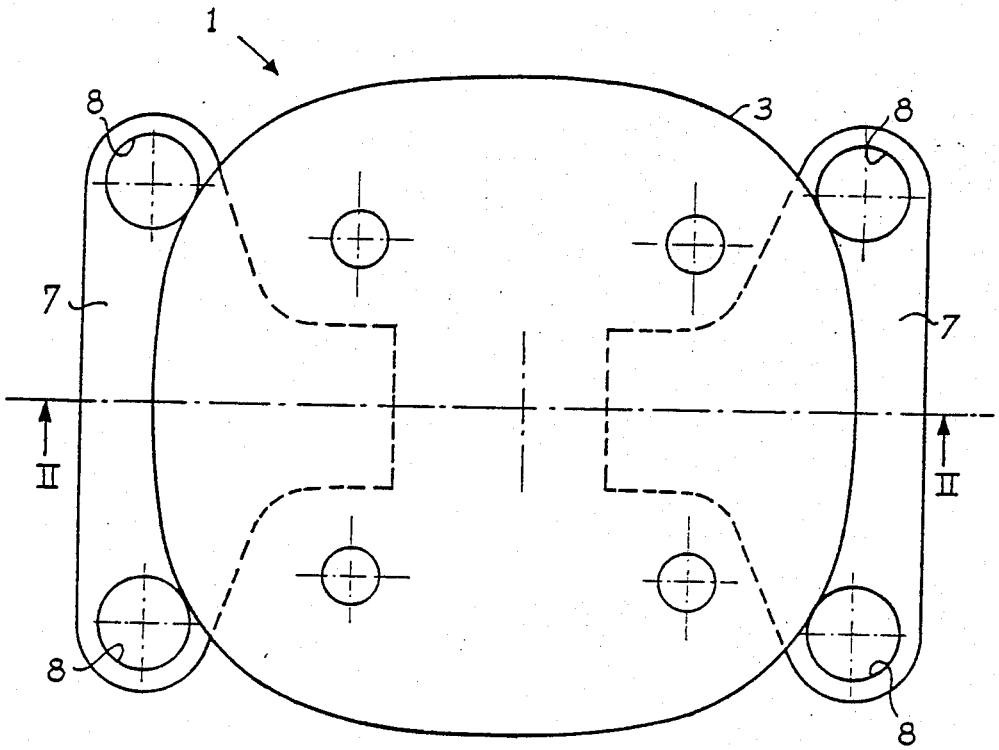
Fig. 1 (PRIOR ART)
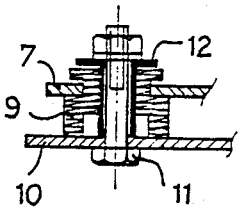
Fig. 3 (PRIOR ART)
Fig. 2 (PRIOR ART)
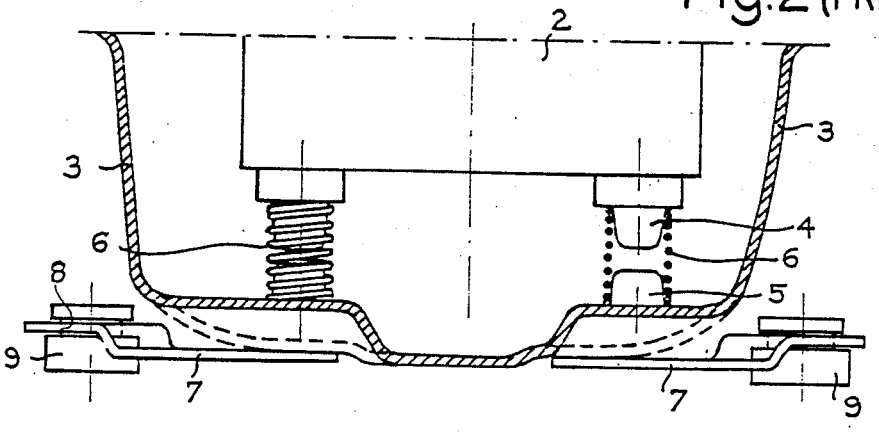

ANTI-VIBRATORY DEVICE TO ATTACH A HERMETIC COMPRESSER CHAMBER TO ITS BASE

SUMMARY OF THE INVENTION

This invention concerns an anti-vibratory device for attaching a hermetic compressor chamber to its base.

BACKGROUND OF THE INVENTION

Existing hermetic compressors, in heat pumps for heating or refrigeration systems, are equipped with a flexible attachment device, usually in two parts. The first part, located inside the hermetic compressor chamber, consists of several springs, providing elastic suspension of the mechanical compressor components, basically a cylinder, a piston, and its motor. The purpose of this first part is to absorb vibrations produced at start-up, during rotation, and at the end of rotation. The second part, located outside the hermetic chamber, comprises several components made from rubber or a similar material, and its purpose, in addition to further absorption of vibrations is to attach the chamber to its base.

In conventional systems, the rubber components are connected to lugs cut and stamped out of metal sheets, and welded to the underside of the compressor chamber. These lugs, although they are simple to make, and fairly easy to weld to the chamber, significantly increase mass-production costs for such compressors.

This invention concerns an anti-vibratory device to attach a compressor chamber to a base, and which is inexpensive and easy to fit.

The invention also concerns an anti-vibratory device of this kind which allows this new type of compressor to be fitted as simply as possible to bases designed for conventional hermetic compressors.

According to one embodiment of the invention, a anti-vibratory device for attaching a hermetic compressor chamber to a base is composed of a first part, located inside the compressor chamber, and comprising several springs held between the compressor and studs fixed to the bottom of the chamber, the underside of each of stud being provided with a threaded recessed hole, accessible from the outside the chamber, and a second part comprising a block of elastic material, fixed on one side to the stud by means of a screw screwed into the recessed hole, and on the other side to the compressor base.

According to one embodiment of the invention, said anti-vibratory device comprises blocks of elastic material, each containing an axial hole, and each such block, located outside the chamber, being attached to the matching stud by means of a screw which passes through the axial hole in the block and screws into the recessed hole in the stud, and further comprises means of fixing the block to the base.

According to another embodiment of the invention, each elastic block of said anti-vibratory device comprises, near one of its ends, a ring-shaped groove, the inside diameter of which is approximately equal to the diameter of a hole bored in the base along the stud axis, so that the end of the hole in the base can fit into the groove in the block.

According to yet another embodiment of the invention, said anti-vibratory device comprising a strengthener socket which is inserted into the axial hole in each block, with a flange which presses against the lower surface of the block, while the screw passes through the socket and presses on the flange.

According to a further embodiment of the invention, each stud having a threaded recessed hole comprises a cylindrical portion with a flange at the base, so that it may be inserted into the chamber until flange stops further movement, through holes bored in the chamber bottom, the diameter of these holes being approximately the same as the outside diameter of the cylindrical part of the stud, and each stud is then welded hermetically to the chamber bottom.

The present invention also relates to a heat pump, as defined herein-above, and comprising a hermetic compressor equipped said anti-vibratory device to attach the hermetic chamber to the base.

BRIEF DESCRIPTION OF THE DRAWINGS

Further features and advantages of the invention are made clear in the following description of one possible embodiment, with reference to the accompanying illustrations:

FIGS. 1 and 2, showing a simplified plan and cross-section of a hermetic compressor with a conventional attachment system according to the prior art;

FIG. 3, showing a detail of the attachment according to the prior art.

DETAILED DESCRIPTION OF THE DRAWINGS

Figure 4:
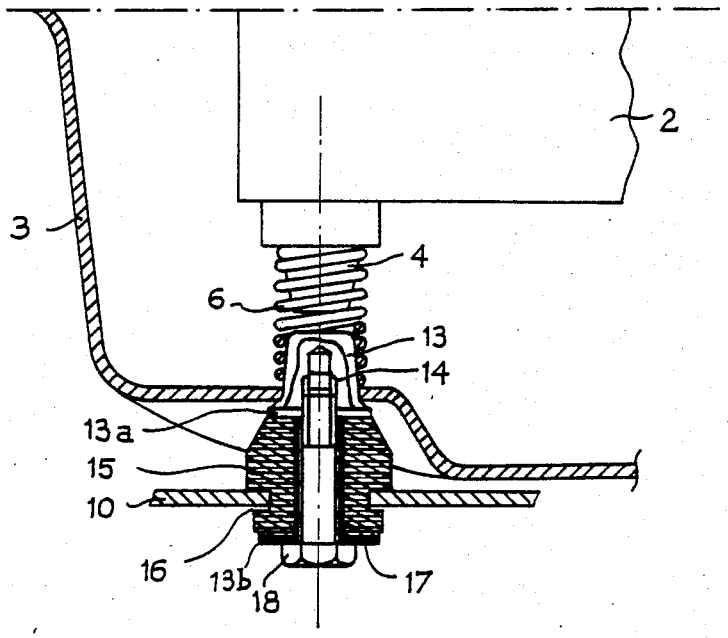
FIG. 4, showing a cross-sectional view of part of this new anti-vibratory attachment device.

FIGS. 1 to 3 show simplified views of a conventional hermetic compressor forming part of a heat pump. The compressor 1 comprises an electro-mechanical assembly 2 (not shown in detail here), mainly constituted with a cylinder, a piston and a motor. This assembly 2, which is enclosed in a hermetic chamber 3, is provided with four cylindrical studs 4 fixed at its base, the free ends of these studs being tapered. Similar studs 5 are welded to the topside of the chamber bottom, so that, when the electro-mechanical assembly 2 is in the right position in relation to the chamber 3, these studs 4 and 5 face one another. Coil springs 6 fit on to the studs, and are held between them.

Lugs 7 are welded to the underside of the chamber bottom. These lugs contain holes 8, which may be four in number, and into which blocks 9 of rubber or similar material are inserted, being attached to the base 10 by means of a bolt 11 and double strengthener 12, as shown in FIG. 3.

In this type of attachment device, lugs have to be manufactured and welded to the chamber bottom. The device illustrated in FIGS. 4 to 6 removes the need for such welding.

The electro-mechanical assembly 2, enclosed inside the hermetic chamber 3, comprises the same studs 4 as in a conventional device. However, the studs 5 are replaced in the present invention, as shown in FIG. 4 by slightly longer studs 13. These studs are cylindrical in shape, and the end on to which the springs fits is tapered, while the outside diameter of the other end, or base, widens over a short distance, to form a flange 13*a*.

These studs 13 are inserted into the chamber, through holes in the chamber bottom, opposite the studs 4, until the flange halts further movement. The diameter of these holes is approximately the same as the outside diameter of the cylindrical portion of the studs 13. The studs 13 are then welded hermetically to the chamber 3. The distance between the ends of studs 4 and 13 is determined as in conventional systems, in such a way that they will not touch each other, even when maximum vibration of the assembly 2 is occurring, and the springs 6 are subject to maximum compression.

The underside of each stud 13 contains a threaded axial recessed hole 14, which remains accessible from outside when the stud is welded to the chamber bottom.

Cylindrical or tapering elastic blocks 15, made of rubber or a similar material, are used to attach the chamber 3 to the base 10. Near one end of these blocks there is a ring-shaped groove 16, the inside diameter of which is approximately equal to the diameter of the attachment holes bored along the base 10, along the same axis as the studs 4 and 13. The depth of the grooves is slightly greater than the thickness of the base 10 in the vicinity of the holes, so as to leave a small clearance between the sides of the groove 16 and the base 10, thereby ensuring that the blocks 15 will retain full flexibility.

Each block 15 also contains an axial hole, into which a strengthener socket 17 fits. This takes the form of a cylindrical tube, ending in a flange **13*b* at one end, the tube being the same length as the block 15, and its outside diameter being slightly greater than the diameter of the axial holed in the block 15. The surface of the block 15 and the surface of the stud flange 13*a* against which it presses are preferably of the same diameter, while the diameter of the other surface of the block 15 is preferably the same as or slightly larger than the diameter of the socket flange 13*b***.

When the blocks 15 are fixed to the base 10, and the strengthener sockets 17 are inserted into the axial holes in these blocks, so that the flanges **13*b* press against the lower surfaces of the blocks (namely the surfaces on the other side of the base 10 from the compressor), suitable screws 18 are inserted into the sockets 17, and screwed into the threaded holes 14 in the studs 13, tightening the studs 13 against the sockets 17. The tubular part of each socket 17 is approximately the same length as the blocks 15, so that tightening of the screws 18** does not cause any crushing of the blocks, which retain their flexibility, and continue to provide a flexible connection between the compressor and its base.

Figure 5:
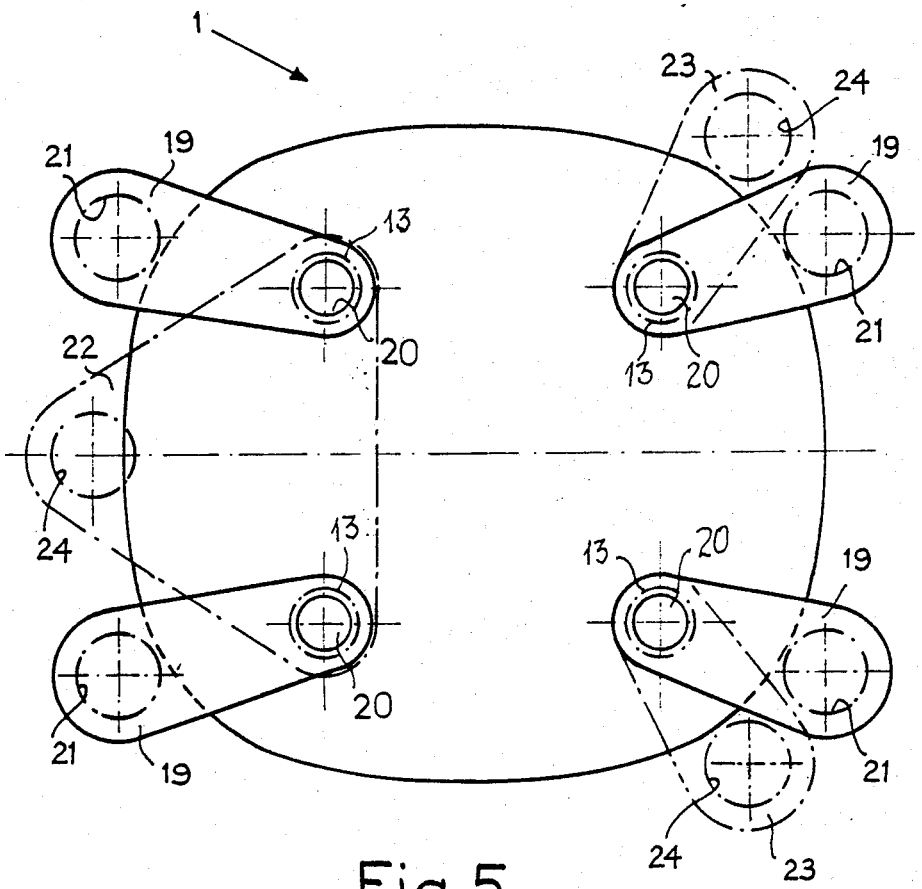
FIG. 5, showing a simplified view of the underside of this new hermetic compressor, mounted on a base designed for a conventional compressor.

FIG. 5 shows, in simplified form, two other embodiments of this new attachment device, used to connect a compressor of this new type to a base designed for conventional compressors, with four and three points of attachment. The new compressor is equipped with studs 13.

For a four-point connection (as shown in FIG. 1), the holes in the base 10 are further away from one another than the studs 13. In another embodiment of the invention, intermediate lugs 19 (indicated by continuous lines in FIG. 5) are fixed directly by one end to the studs 13, by screws 18, which pass through holes 20, and screw into the threaded recessed holes 14 in the studs 13. The other end of these lugs 19 contain holes 21 of the same diameter as the holes 8 in the lugs 7 of conventional devices. The space between the holes 21, in relation to the corresponding studs 13, is equal to the space between the holes 8, in relation to the studs 5 of a conventional system. Blocks 9 of elastic material are inserted into the holes 21 of these lugs 19, and are fixed to the base 10 in the way illustrated in FIG. 3.

Figure 6:
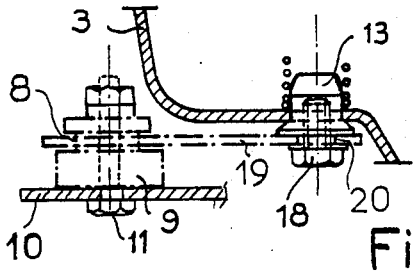
FIG. 6, showing a cross-sectional view of part of the device for attaching in FIG. 5 to its base.

For a three-point connection to a conventional base 10, two kinds of lugs are used: one lug 22, and two lugs 23 similar to the lugs 19 (these lugs 22 and 23 are indicated by broken lines in FIG. 5). The lug 22, which is of generally triangular shape, is attached to two studs 13, with strengtheners to compensate for the depressions in the recessed holes in the studs 13, if the lug is flat, or directly, if the lug is curved to match the shape of the chamber bottom. The two lugs 23 contain holes 24 of the sam diameter as the holes 21, which are used to attach the chamber 3 to the base 10 by means of rubber blocks similar to the blocks 9 in FIG. 3. The form of attachment is illustrated in FIG. 6.

By using lugs 19, or 22 and 23, the new type of compressor can be attached easily and without excessive cost to a base designed for a conventional compressor.

It is also possible to use shorter studs 13 than those described above: in this case they are located completely inside the chamber 3, their bases being welded to the inside of the chamber bottom, with holes in this bottom, on the stud axes, for the screws to pass through.

What is claimed is:

1. An anti-vibratory device for attaching a hermetic compressor chamber with an assembly therein to a base comprising:

at least one stud adapted to extend through said chamber from the underside and to be fixed thereto, the underside of each said stud having a threaded recessed hole accessible from outside said chamber;

a spring mounted between each stud and said assembly for coupling said assembly to said chamber;

a block of elastic material between each said stud and said base; and a screw extending into said recessed hole for fixing said block to said stud.

2. A device as claimed in claim 1, comprising a plurality of studs and blocks of elastic material, each containing an axial hole, and each such block, located outside the chamber, being attached to a matching stud by means of the screw which passes through the axial hole in the block to the base.

3. A device as claimed in claim 2, wherein near one end of each elastic block is a ring-shaped groove having an inside diameter which is approximately equal to the diameter of a hole bored in the base along the stud axis.

4. A device as claimed in claim 3, wherein a strengthener socket is inserted into the axial hole in each block, with a flange which presses against a lower surface of the block, while the screw passes through the socket and presses on the flange.

5. A device as claimed in claim 1, wherein each stud comprises a cylindrical portion with a flange at the base, so that it may be inserted into the chamber, until this flange stops further movement, through holes bored in the chamber bottom, the diameter of these holes being approximately the same as the outside diameter of the cylindrical portion of the stud, and each stud is then welded hermetically to the chamber bottom.

6. A device as claimed in claim 5, to attach a compressor to a conventional base, comprising intermediate lugs, attached at one end to the studs by means of screws, and containing holes at the other end, bored along the same axes as the holes in the base designed to take the blocks of elastic material, into which elastic blocks are fitted.

* * * * *